US007549363B2

(12) United States Patent
Rote et al.

(10) Patent No.: US 7,549,363 B2
(45) Date of Patent: Jun. 23, 2009

(54) PRODUCT TABLE FOR A FOOD SLICER WITH HOLLOW PERIPHERAL REINFORCEMENTS

(75) Inventors: Scott J. Rote, New Lenox, IL (US); Michael R. Riechers, Grant Park, IL (US); Aaron B. Eiger, Chicago, IL (US); Frank Bondarowicz, Park Ridge, IL (US)

(73) Assignee: Premark FEG L.L.C., Wilmington, DE (US)

( * ) Notice: Subject to any disclaimer, the term of this patent is extended or adjusted under 35 U.S.C. 154(b) by 129 days.

(21) Appl. No.: 11/349,415

(22) Filed: Feb. 7, 2006

(65) Prior Publication Data

US 2007/0044625 A1 Mar. 1, 2007

Related U.S. Application Data

(60) Provisional application No. 60/711,782, filed on Aug. 26, 2005.

(51) Int. Cl.
*B26D 7/06* (2006.01)

(52) U.S. Cl. ..... 83/707; 83/932

(58) Field of Classification Search ..... 83/932, 83/707–731; D7/383; 52/630, 800.1, 796.12, 52/797.1

See application file for complete search history.

(56) References Cited

U.S. PATENT DOCUMENTS

| | | | | |
|---|---|---|---|---|
| 2,476 | A | 2/1842 | Morris | |
| 19,982 | A | 4/1858 | Conroy | |
| 28,179 | A | 5/1860 | Hunter | |
| 1,424,875 | A | 8/1922 | Braun | |
| 1,428,292 | A | 9/1922 | Lucey | |
| 1,840,845 | A | 1/1932 | Lucy | |
| 1,902,908 | A * | 3/1933 | Sensow | 83/717 |
| 1,917,365 | A * | 7/1933 | Goertz et al. | 52/731.2 |
| 1,939,740 | A | 12/1933 | Van Berkel | |

(Continued)

FOREIGN PATENT DOCUMENTS

| | | | |
|---|---|---|---|
| DE | 8423478 U | 12/1985 | |

(Continued)

OTHER PUBLICATIONS

International Search Report, mailed Nov. 24, 2006, PCT/US2006/031603 filed Aug. 11, 2006.

(Continued)

*Primary Examiner*—Stephen Choi
(74) *Attorney, Agent, or Firm*—Thompson Hine LLP

(57) ABSTRACT

A food slicer is provided having a support member including a base portion and an upstanding portion integrally formed with the base portion. The upstanding portion includes a rotating cutting blade secured thereto for slicing food product and at least one motor positioned within the upstanding portion for rotating the cutting blade. An adjustable gage plate also is provided for determining the thickness of a food product to be sliced by the cutting blade. The base portion includes a food product table slidably secured thereto and is movable across the cutting blade for holding product while it is being sliced by the cutting blade. The food product table has at least one peripheral reinforcement along an edge thereof where the reinforcement has a hollow channel therein.

7 Claims, 4 Drawing Sheets

U.S. PATENT DOCUMENTS 1,948,811 A 2/1934 Van Berkel
1,977,418 A 10/1934 Winkler
2,026,096 A 12/1935 Muhlbauer
2,052,365 A 8/1936 Stukart
2,052,367 A 8/1936 Folk
2,486,797 A 11/1949 Meyer
2,563,120 A 8/1951 Klingens et al.
2,573,629 A 10/1951 Klingens et al.
2,598,740 A 6/1952 Zimmermann
2,614,373 A 10/1952 Van Duyn et al.
2,665,531 A 1/1954 Sivertsen
2,691,397 A * 10/1954 Klingens ..... 83/717
2,728,176 A 12/1955 Ritzert
3,051,207 A 8/1962 Hartley
3,124,185 A 3/1964 Karp
3,176,560 A 4/1965 Bardenhagen
3,182,700 A 5/1965 Engi
3,319,681 A 5/1967 Anecki
3,320,990 A 5/1967 Anecki
3,442,312 A 5/1969 Karp
3,452,833 A 7/1969 Wolters
3,583,452 A 6/1971 Muller
3,613,754 A 10/1971 Hartley
3,672,420 A 6/1972 Hartley
3,677,316 A 7/1972 Markham
3,706,736 A 12/1972 Pratley
3,713,470 A 1/1973 Muller
3,736,825 A 6/1973 Covell
3,739,677 A 6/1973 Muller
3,771,404 A * 11/1973 Richards et al. ..... 83/713
3,772,951 A 11/1973 Repetto
3,782,230 A 1/1974 Bettcher
3,857,310 A 12/1974 Tiby
3,871,260 A 3/1975 Rees
3,938,602 A 2/1976 Sly et al.
3,958,475 A 5/1976 Zapomel
3,958,478 A 5/1976 Camper
3,965,783 A 6/1976 Muller
3,986,304 A 10/1976 Shie
4,015,494 A 4/1977 Spooner
4,186,634 A 2/1980 Akczinski, Sr.
4,227,656 A 10/1980 Engebretsen
4,246,818 A 1/1981 McGraw, Jr.
4,266,456 A 5/1981 Oostvogels
D259,883 S 7/1981 Engebretsen
4,306,685 A 12/1981 Burton
4,386,483 A 6/1983 Schlaefli
4,434,694 A 3/1984 Scharsig
4,499,804 A 2/1985 Takeda
4,528,777 A 7/1985 Bernstein et al.
4,532,840 A 8/1985 Antonissen
4,541,319 A 9/1985 Maurer et al.
4,543,868 A 10/1985 Maurer et al.
4,546,685 A 10/1985 Maurer et al.
4,653,373 A 3/1987 Gerber
4,685,364 A 8/1987 Scheflow et al.
4,732,056 A 3/1988 Foster
4,732,064 A 3/1988 Pearl
4,793,228 A 12/1988 Etter et al.
4,811,521 A 3/1989 Nakae et al.
4,813,316 A 3/1989 Johnson et al.
4,817,480 A 4/1989 Young
4,829,721 A 5/1989 Wright
4,962,581 A 10/1990 Rutigliano
5,001,887 A 3/1991 Eder et al.
5,038,647 A 8/1991 Biagiotti
5,101,704 A 4/1992 Jones et al.
5,152,105 A 10/1992 Belvederi
5,188,011 A 2/1993 Somal et al.
5,209,150 A 5/1993 Arconada
5,224,407 A 7/1993 Koch et al.
5,241,885 A 9/1993 Kuchler
5,294,044 A * 3/1994 Clark ..... 229/191
5,461,957 A 10/1995 Koch et al.
5,477,760 A * 12/1995 Kuchler ..... 83/58
5,477,796 A 12/1995 Nedoschinsky et al.
5,509,337 A 4/1996 Norman
5,615,591 A 4/1997 Scherch et al.
5,649,463 A 7/1997 Lindee et al.
5,666,866 A 9/1997 Huang et al.
5,687,626 A 11/1997 Scherch et al.
5,787,776 A 8/1998 Nishimoto
5,855,234 A * 1/1999 Everts et al. ..... 144/135.2
5,941,148 A 8/1999 Miller et al.
5,970,840 A 10/1999 Yan et al.
6,016,734 A 1/2000 Koch
6,092,448 A 7/2000 Cartwright et al.
6,092,450 A 7/2000 Dueck
6,131,359 A * 10/2000 Duff ..... 52/706
6,167,791 B1 1/2001 Heckman et al.
6,209,438 B1 4/2001 Mitchell et al.
D463,713 S 10/2002 Zhu
2001/0018317 A1 8/2001 Yan
2001/0049987 A1 12/2001 Vivirito et al.
2002/0069737 A1 * 6/2002 Zhu ..... 83/91
2003/0079595 A1 * 5/2003 Shariff et al. ..... 83/713
2003/0200854 A1 * 10/2003 Graef et al. ..... 83/707

FOREIGN PATENT DOCUMENTS

EP 0115788 A1 8/1984
EP 0202777 A2 11/1986
EP 0248354 A2 12/1987
EP 0386393 A 9/1990
EP 0724931 A1 8/1996
EP 0776265 A1 6/1997
EP 0777202 A2 6/1997
EP 0827816 A1 3/1998
EP 0 881 045 A2 12/1998
EP 0972619 A2 1/2000
GB 1560874 2/1978
GB 2021452 A 12/1979
GB 2061780 A 5/1981
NL 61454 C 9/1947
WO WO 94/11279 5/1994
WO WO 95/32846 12/1995
WO WO 95/33601 12/1995
WO WO 96/05952 2/1996
WO WO 98/55277 12/1998
WO WO 9955500 A 11/1999
WO WO 00/40367 7/2000
WO WO 00/66333 11/2000
WO WO-2007024527 * 3/2007

OTHER PUBLICATIONS

International Preliminary Report on Patentability issued regarding International Application No. PCT/US2006/031603 (Mar. 6, 2008).

* cited by examiner

PRODUCT TABLE FOR A FOOD SLICER WITH HOLLOW PERIPHERAL REINFORCEMENTS

CROSS-REFERENCE TO RELATED APPLICATIONS

This application claims benefit of U.S. provisional patent application Ser. No. 60/711,782, filed Aug. 26, 2005, which is herein incorporated by reference.

TECHNICAL FIELD

The present invention relates generally to food slicers and more particularly to a new design for a food slicer table that is of a reduced weight while having the needed rigidity that, when utilized with a new overall food slicer design, provides an improved sanitary environment, enables easier operation and cleaning and incorporates a number of enhanced ergonomic features.

BACKGROUND

The basic design of both manual and automatic food slicers has proven to be quite effective and durable throughout the years. Although various important improvements have been made to such slicers, the overall design has not changed very much particularly with regard to the overall cleanliness, ergonomics, or ease of operation.

Today, food slicers are utilized to slice a number of food products such as meats, cheeses and the like in a variety of environments such as delicatessens, supermarkets, and restaurants to name a few. Such food slicers need to be quite durable since they tend to be used for many hours during a day by many different individuals while providing the desired performance, safety and cleanliness.

Additionally, food slicers need to be quite accommodating since they need to handle a variety of products of different shapes and sizes while readily providing different thicknesses of the product being sliced. The speed at which a particular product is moved across the cutting blade also varies on automatic food slicers to improve productivity.

Since food product tables of food slicers move back and forth across the cutting blade, they typically are made from metal, such as aluminum or stainless steel, to decrease the weight. Although some food product tables have been formed from plastic, they typically do not have the rigidity needed to handle a variety of products over years of extended use.

SUMMARY

In accordance with an embodiment, a food slicer is provided having a support member including a base portion and an upstanding portion integrally formed with the base portion. The upstanding portion includes a rotating cutting blade secured thereto for slicing food product and at least one motor positioned within the upstanding portion for rotating the cutting blade.

An adjustable gage plate also is provided for determining the thickness of a food product to be sliced by the cutting blade.

The base portion includes a food product table slidably secured thereto and is movable across the cutting blade for holding product while it is being sliced by the cutting blade. The food product table includes at least one peripheral reinforcement along an edge thereof where the reinforcement has a hollow channel therein.

BRIEF DESCRIPTION OF THE DRAWINGS

The present disclosure will become better understood with reference to the following description and accompanying drawings, wherein.

DETAILED DESCRIPTION

Figure 1:
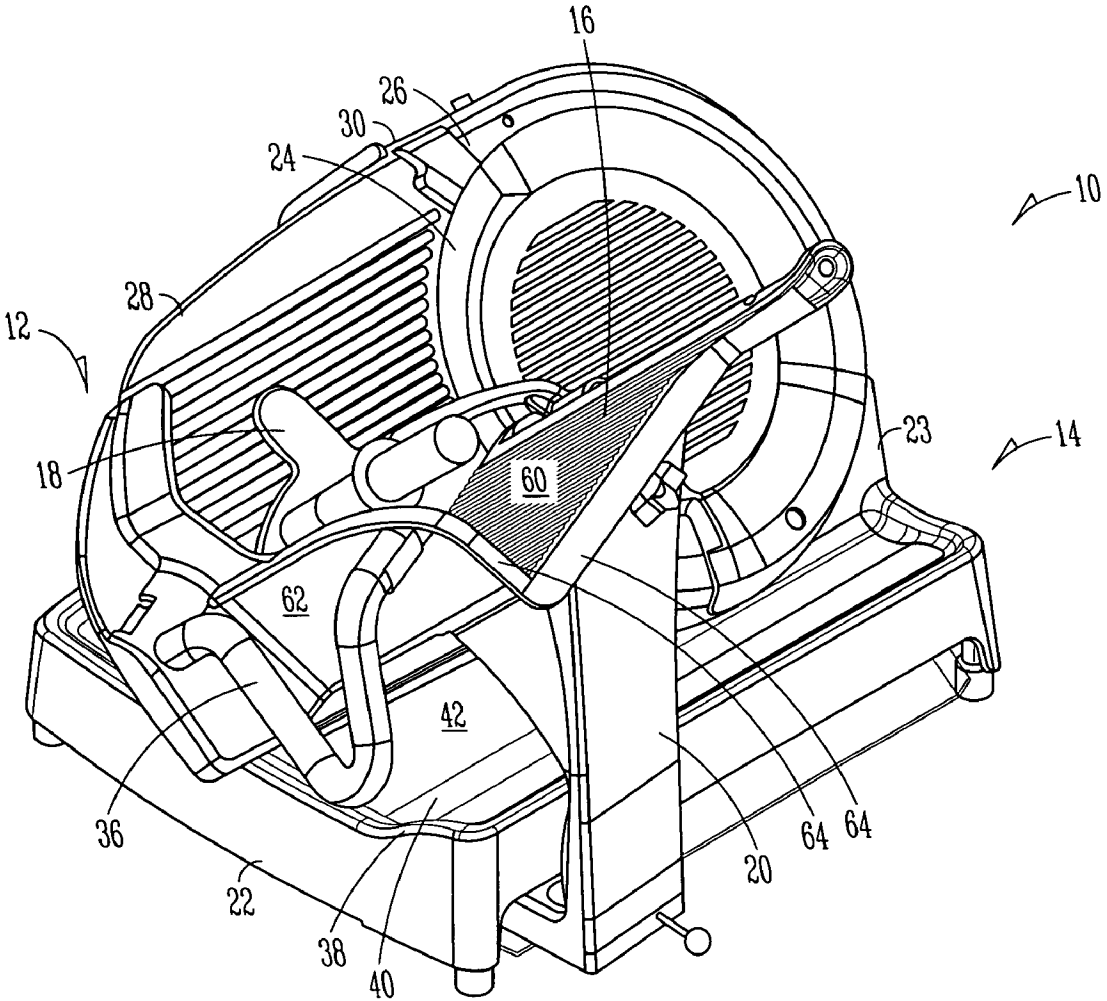
FIG. 1 is a top right perspective view of a food slicer according to one embodiment of the present invention.

The food slicer of the present invention is generally illustrated by numeral 10 of FIG. 1 wherein like parts are designated by like reference numerals. Although the present disclosure will be described with reference to the example embodiments illustrated in the figures, it should be understood that the food slicer 10 may have many alternative forms without departing from the teachings of the present invention. One of ordinary skill in the art will additionally appreciate different ways to alter the parameters of the embodiments disclosed, such as the size, shape, or type of elements or materials, in a manner that falls within the spirit and scope of the present disclosure and appended claims.

FIG. 1 illustrates the basic components of the food slicer 10 of the present invention. The food slicer 10 substantially includes a food handling portion generally illustrated by reference numeral 12 and a support portion, housing or member generally illustrated by reference numeral 14.

Figure 2:
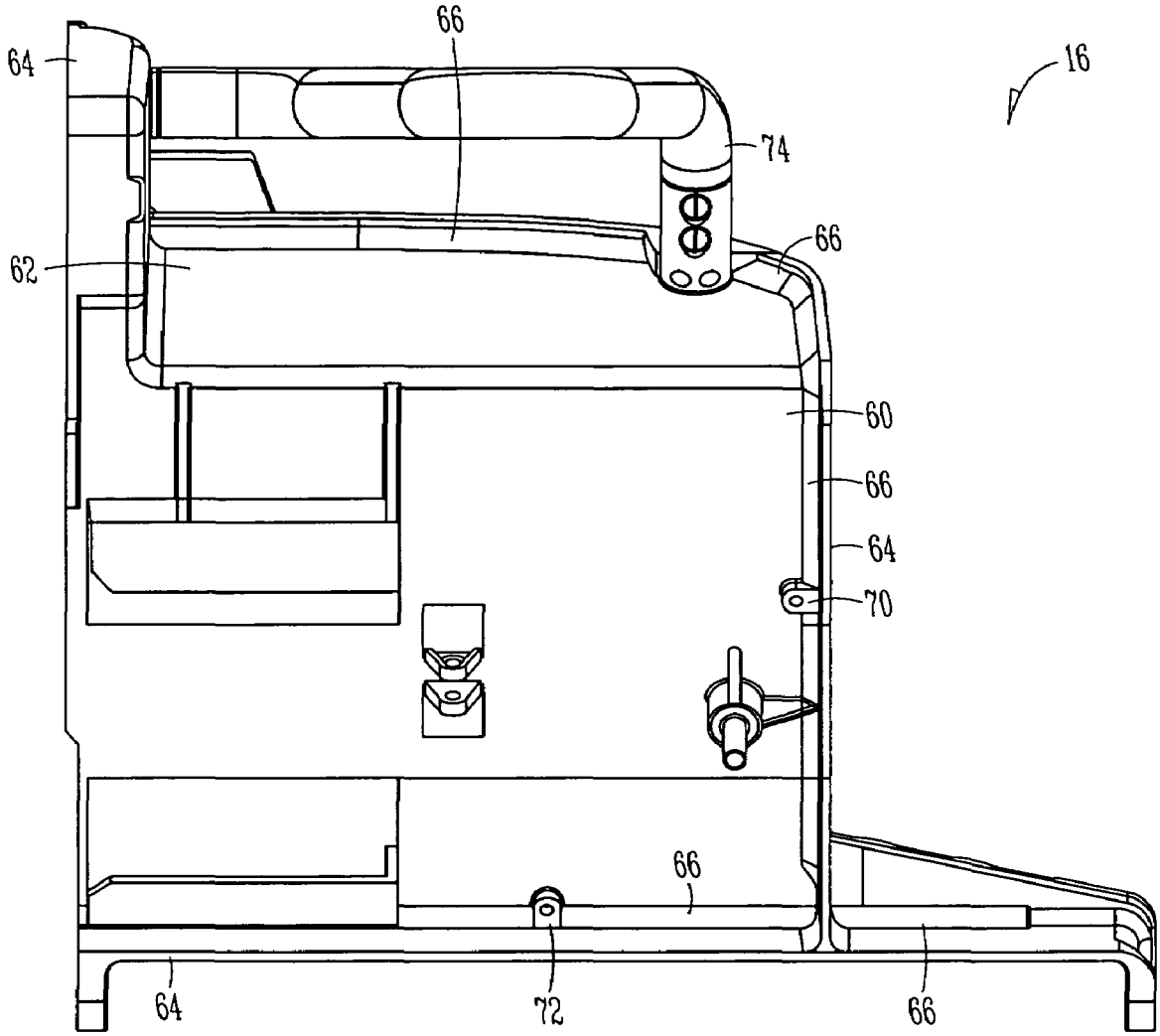
FIG. 2 is a bottom perspective view of one embodiment of a food product table of FIG. 1.

The food handling portion 12 substantially includes a product table 16, a push arm or pusher 18 and a product table support arm 20. The support portion 14 substantially includes a base portion or member 22, an upstanding portion or member 23, a rotating circular slicing knife or cutting blade 24, a ring guard 25, a knife cover 26, an adjustable gage plate 28 for determining slicing thickness and a control member or operator interface 30 having a gage plate support and adjustment mechanism 32 for the gage plate 28 and control buttons 34 as illustrated in FIG. 2.

The support portion 14 also includes at least one motor (not illustrated) positioned within the inside of the upstanding portion 23. If desired, a second motor (not illustrated) may be positioned within the inside of the support portion 14 along with associated structure for automatically moving the product table 16.

Briefly, for manual slicing, a food product (not illustrated) is placed on the product table 16 beneath the pusher 18 with the end to be cut or sliced resting upon the gage plate 28 with the product table 16 in its forward position. The operator adjusts the gage plate adjustment mechanism 32 which directly moves the gage plate 28 with respect to the blade 24 to provide a slice thickness gap therebetween that corresponds to the desired thickness for slicing of the product and gets bigger with thicker slices. The control buttons 34 are then accessed to turn the motor on which in turn rotates the blade 24.

The operator then pushes the product table 16 via a handle 36 forward or to the right with respect to FIG. 1 whereby the blade 24 slices the product to the desired thickness. The operator then pulls the product table 16 backward or to the left with respect to FIG. 1 for continued slicing of the product as described above.

As FIGS. 1-4 generally illustrate, product table 16 may be constructed to have a bottom portion 60 upon which the food product to be sliced may sit, and a side portion 62 for the food product to rest against while being sliced. The particular design of the product table 16 can vary so long as it functions to hold the food product during slicing as desired.

In order to provide for enhanced rigidity of the product table 16, a lip 64 is included along one or more edges of the bottom portion 60 and/or the side portion 62. To further enhance the rigidity of the product table 16, one or more reinforcements 66 are provided between the bottom portion 60 and the lip 64 and the side portion 62 on a bottom side of the product table 16.

Figure 5:
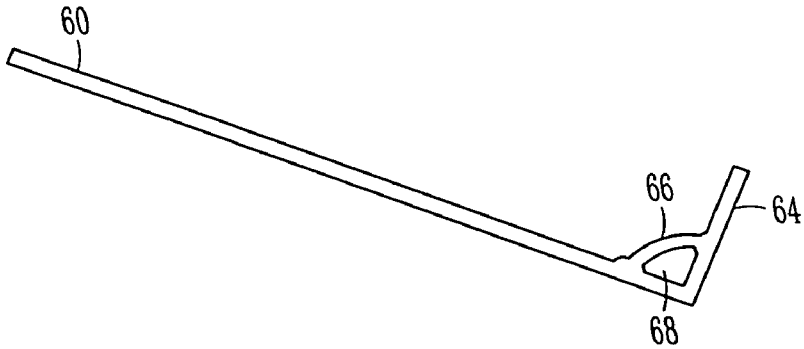
FIG. 5 is a cross-sectional view of the food product table taken along lines 5-5 of FIG. 4.

As FIG. 5 illustrates, the reinforcements 66 include a hollow channel 68 that extends longitudinally through the length of each reinforcement 66. The reinforcements 66 are closed at their ends and, for ease of molding, typically do not cross each other.

The reinforcements 66 and associated hollow channels 68 preferable are integrally formed with the bottom portion 60 and lip 64 or side portion 62 during molding. To form the hollow channels 68, a gas-assist injection molding process preferably is used where a gas, typically nitrogen, is injected into the material during molding, at one or more desired locations such as at points 70 and 72, at a specific temperature and pressure at a desired point in time during the molding process.

Figure 3:
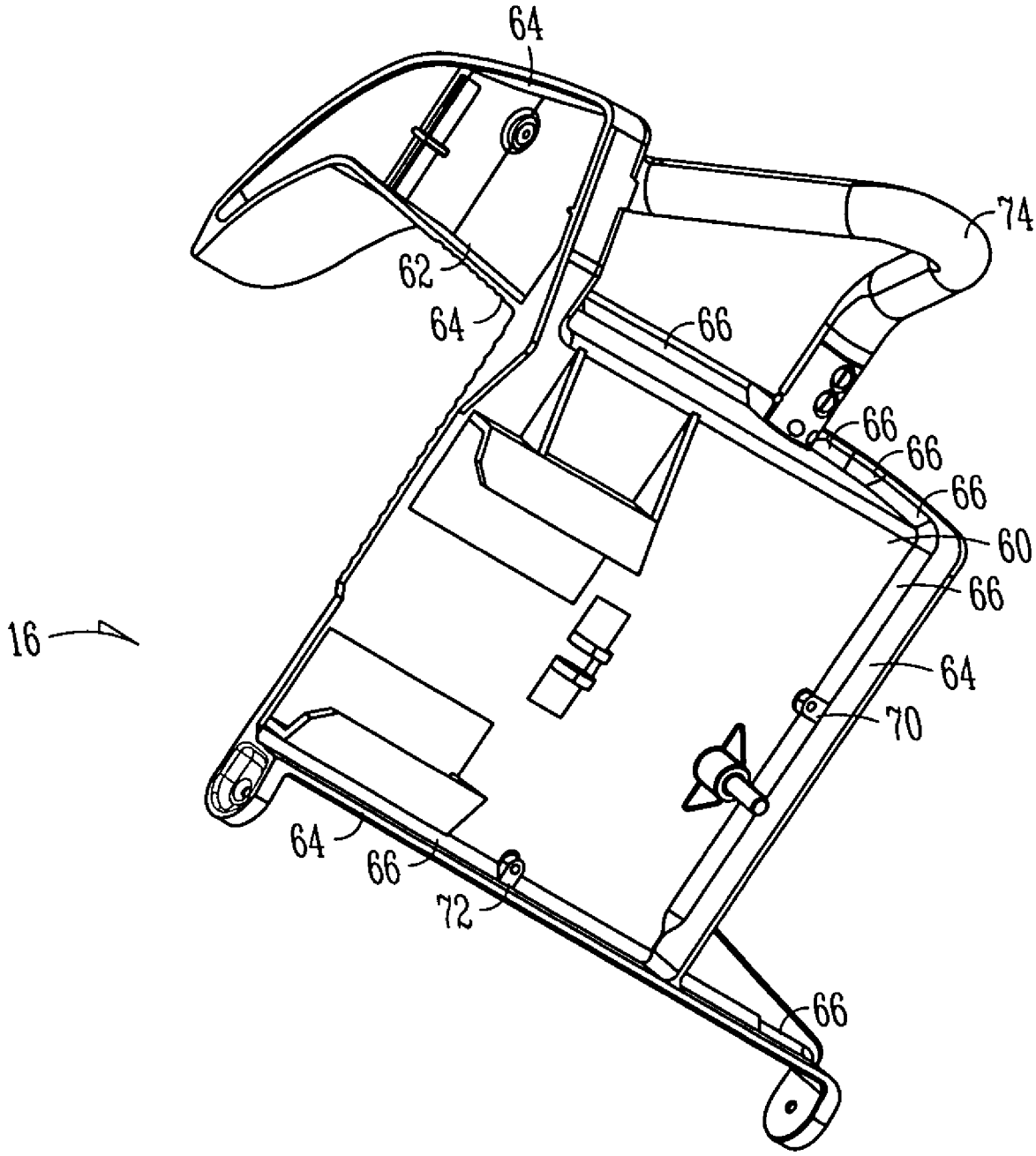
FIG. 3 is a bottom perspective view of the food product table of FIG. 2 taken at a slightly different angle.
Figure 4:
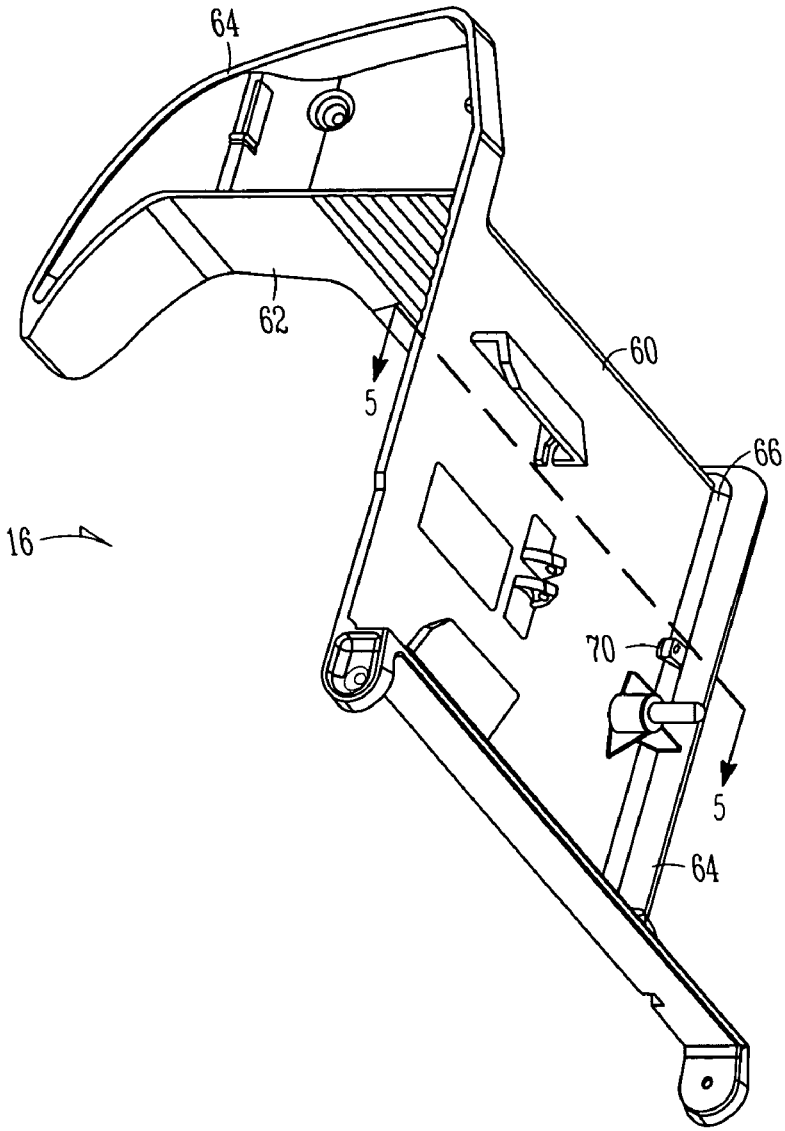
FIG. 4 is a bottom perspective view of the food product table of FIG. 2 taken at a slightly different angle.

In this embodiment, gas injected at molding point 72 forms a continuous hollow channel 68 in the reinforcement 66 that runs along the bottom of the product table 16 illustrated in FIGS. 2 and 3 including beneath the lip 64 on the right side of the product table 16. Similarly, gas injected at molding point 70 forms a continuous hollow channel 68 in the reinforcement 66 that runs along the right and top side of the product table 16 including beneath a handle 74. It is to be understood, however, that the specific design, material, shape and method of molding the reinforcements 66 and hollow channels 68, as well as the way they are attached to the bottom portion 60 and lip 64 and the number and placement of the gas injection points 70 and 72, can vary.

The product table 16 preferably is formed from plastic to decrease weight since the product table 16 is a moving component of the slicer 10 and is removable for cleaning. To further enhance the rigidity of the product table 16, the product table 16 can be formed to include additional strengthening members, such as solid ribs or channels, or a strengthening material or additive, such as glass or the like. In practice, using 30% glass filled nylon provides the desired rigidity but it is to be understood that the particular material used to form the product table 16 as well as they type and amount of any strengthener or additive or strengthening member can vary.

Numerous modifications and alternative embodiments of the present disclosure will be apparent to those skilled in the art in view of the foregoing description. Accordingly, this description is to be construed as illustrative only and is for the purpose of teaching those skilled in the art the best mode for carrying out the present disclosure. Details of the structure may vary substantially without departing from the spirit of the present disclosure, and exclusive use of all modifications that come within the scope of the appended claims is reserved. It is intended that the present disclosure be limited only to the extent required by the appended claims and the applicable rules of law.

What is claimed is:

1. A food slicer, comprising:

a support member having a base portion and an upstanding portion integrally formed with said base portion;

a rotating cutting blade secured to said upstanding portion for slicing food product;

at least one motor positioned within said upstanding portion for rotating said cutting blade;

an adjustable gage plate for determining the thickness of a food product to be sliced by said cutting blade; and a food product table slidably secured to said base portion and movable across said cutting blade for holding product while being sliced by said cutting blade, said food product table including a bottom portion including a surface upon which food product sits during slicing, a side portion angled relative to the bottom portion including a surface that food product rests against during slicing, the side portion meeting the bottom portion to form an inner corner that extends to an outwardly located peripheral edge of the food product table, and at least one reinforcement along the outwardly located peripheral edge, said reinforcement having a hollow channel therein that extends along the length of the reinforcement; and wherein the outwardly located peripheral edge is a first peripheral edge of the bottom portion, and wherein the food product table includes a second hollow channel peripheral reinforcement located along a second peripheral edge of the side portion, the second peripheral edge meeting the first peripheral edge at the inner corner.

2. The food slicer as defined in claim 1, wherein said food product table, including said reinforcement, is molded.

3. The food slicer as defined in claim 2, wherein said food product table includes at least one of a strengthening material or member.

4. The food slicer as defined in claim 3, wherein said strengthening material of said food product table is glass filled nylon.

5. The food slicer of claim 1, wherein the product table is formed of plastic and each of the hollow channel peripheral reinforcements is formed integral with the food product table.

6. The food slicer of claim 5, wherein the hollow channel peripheral reinforcement of the bottom portion is integrally formed with a downwardly extending peripheral lip of the bottom portion.

7. The food slicer of claim 1, wherein the hollow channel peripheral reinforcement of the bottom portion extends in a direction transverse to the hollow channel peripheral reinforcement of the side portion.

* * * * *